US005470300A

United States Patent [19]

Terranova

[11] Patent Number: 5,470,300

[45] Date of Patent: Nov. 28, 1995

[54] WEB REGISTRATION SYSTEM AND METHOD

[75] Inventor: Peter Terranova, Ridgewood, N.Y.

[73] Assignee: Ro-An Industries Corporation, Middle Village, N.Y.

[21] Appl. No.: 942,628

[22] Filed: Sep. 9, 1992

[51] Int. Cl.[6] ..... B31B 1/02

[52] U.S. Cl. ..... 493/11; 493/22; 493/24; 493/29; 493/239; 83/75; 83/209; 83/371; 83/365; 226/27; 226/32

[58] Field of Search ..... 493/10, 11, 22, 493/24, 29, 193, 194, 195, 196, 89, 223, 224, 227, 239; 226/27, 32; 83/72, 75, 74, 209, 371, 367, 365

[56] References Cited

U.S. PATENT DOCUMENTS 4,781,317 11/1988 Ditto ..... 226/27
5,000,725 3/1991 Bauknecht ..... 493/24
5,041,070 8/1991 Blaser ..... 493/22

OTHER PUBLICATIONS

"Photoelectric Register Controls"–by Allan Lytel of General Electric, pp. 38, 39, (Jan. 1960).

*Primary Examiner*—Bruce M. Kisliuk
*Assistant Examiner*—Eileen P. Morgan
*Attorney, Agent, or Firm*—Steinberg, Raskin & Davidson

[57] ABSTRACT

A system and method in the manufacture of plastic bags for accurately registering a web having graphic material printed repetitively thereon with respect to a transverse cutting and sealing device comprise detecting the passage of an eyemark printed on the web by a certain location at an initial part of a web index, calculating the initial length travelled by the web from the start of the web index to the detection of the eyemark, and then adjusting a predetermined draw length of the web based upon that calculated initial length.

32 Claims, 4 Drawing Sheets

WEB REGISTRATION SYSTEM AND METHOD

This invention relates generally to methods and apparatus for manufacturing plastic bags by transversely cutting and sealing a plastic web at spaced locations and, more particularly, to such methods and apparatus in which the webs have graphic material printed repetitively thereon.

Certain types of plastic bags are typically manufactured by drawing an elongate tubular plastic web from a supply roll and then cutting and sealing the web transversely at spaced locations to form the bags. The webs are either clear, i.e. are devoid of any graphics, or have graphic material printed repetitively in fields that are spaced along the length of the web. In the latter case, it is important that the web be accurately cut and sealed at specific areas between adjacent fields of graphics so that each bag that is produced depicts a complete graphic field.

In the manufacture of printed plastic bags, the repetitively printed webs are advanced a predetermined draw length generally equal to the length of the graphic field until the web is positioned so that a non-printed area of the web situated between the printed fields is positioned below a transverse cutting and sealing bar. The cutting and sealing bar then descends to cut and seal the web on the non-printed area between adjacent printed fields. The cutting and sealing bar is then raised whereupon the web is again advanced or indexed a predetermined distance for the next cutting and sealing operation. However, this technique has not been entirely satisfactory. For example, the actual lengths of the printed fields may vary due to stretching or shrinkage of the web, either before, during, or after the web printing operation. In such cases the repeated indexing of the web over a constant draw length will result in progressively increasing misalignments between the cutting and sealing bar and the non-printed areas of the web between adjacent printed fields.

For this reason, repetitively printed webs have been provided with regularly spaced "eyemarks" along their margins, and bag making machines have been provided with optical sensors adapted to detect each eyemark as it passes the sensor. The sensor generates a signal upon detecting an eyemark which causes the advancing web to stop so that it can be cut and sealed. Although this technique is on the whole more accurate than simply advancing the web over a fixed draw length in that it avoids the possibility of small misalignments progressively growing larger until the webs are cut and sealed on the printed fields of the bags themselves, it also is not entirely satisfactory. For example, it is not uncommon for graphic material in the printed field to appear near the margin of the web at which the eyemarks are printed and be mistaken by the sensor as such an eyemark. For this reason systems have been designed in which the optical sensor is enabled only over a small interval in which the eyemark is expected to be seen. Although such systems are effective in correcting errors resulting from intermittent variations in distances between the eyemarks, progressive errors can still arise resulting in the eyemarks appearing outside of the interval in which the optical sensor is enabled.

SUMMARY OF THE INVENTION

Accordingly, it is an object of the present invention to provide new and improved web registration systems and methods for use in manufacturing plastic bags.

Another object of the present invention is to provide new and improved systems and methods for manufacturing plastic bags bearing printed fields by transversely cutting and sealing a plastic web.

Still another object of the present invention is to provide new and improved systems and methods utilizing optical scanners or sensors in the manufacture of printed plastic bags from webs having repetitive graphic fields printed thereon.

Briefly, in accordance with the present invention, these and other objects are attained by providing in a bag making machine for making plastic bags from an elongate web of plastic material having a series of regularly spaced eyemarks printed thereon, an improvement comprising the combination of draw roll means for intermittently advancing or indexing a web over a predetermined draw length, optical sensor means for detecting the passage of an eyemark by a certain location at the beginning of each web index, means for calculating during each ongoing web index, an "initial length" travelled by the web at the beginning of that web index from the beginning of the web index until the optical sensor detects an eyemark, and means for adjusting the predetermined draw length for that ongoing web index based upon the calculated initial length of travel. Thus, unlike conventional registration systems, the position of the eyemark is sensed at the beginning of each web index rather than at the end and appropriate adjustments of the draw length and made for each web index during the course of that web index.

Two items of information are entered by the machine operator during initial set up, namely the nominal bag length, normally the distance between successive eyemarks, and the length of a registration "window", i.e. the length of web travel in which an eyemark will normally be detected after the beginning of the ongoing web index. This information is used to calculate the predetermined draw length for each upcoming web index.

In a preferred embodiment of the invention, prior to starting the bag machine, the values of the length of the registration window and the nominal bag length are entered into a controller whereupon a draw length is predetermined for the upcoming web indexes. The operator then aligns the web on the machine so that an eyemark is just about to come into view of the optical sensor. Upon receipt of a run signal, the controller initiates the advancement of the web and, upon detection of the eyemark by the optical sensor, calculates and stores the initial length travelled by the web from the beginning of its movement until the eyemark has been detected. The predetermined draw length of the ongoing web index is then adjusted based upon the value of the initial length and the "state" of the machine at the beginning of the web index, the latter of which is determined by the previous web index as described below.

BRIEF DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
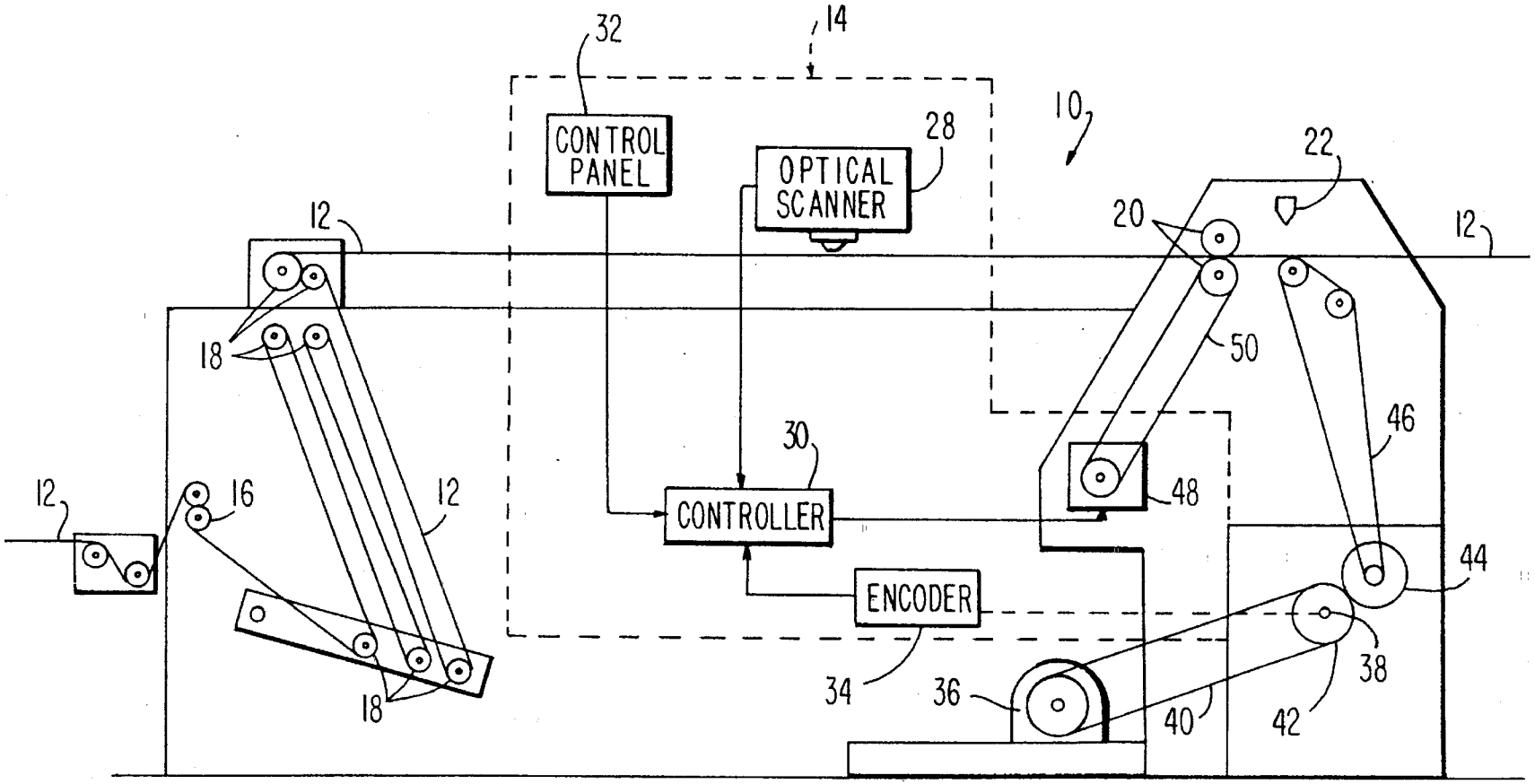
FIG. 1 is a schematic diagram of a bag machine incorporating a web registration system in accordance with the present invention.
Figure 2:
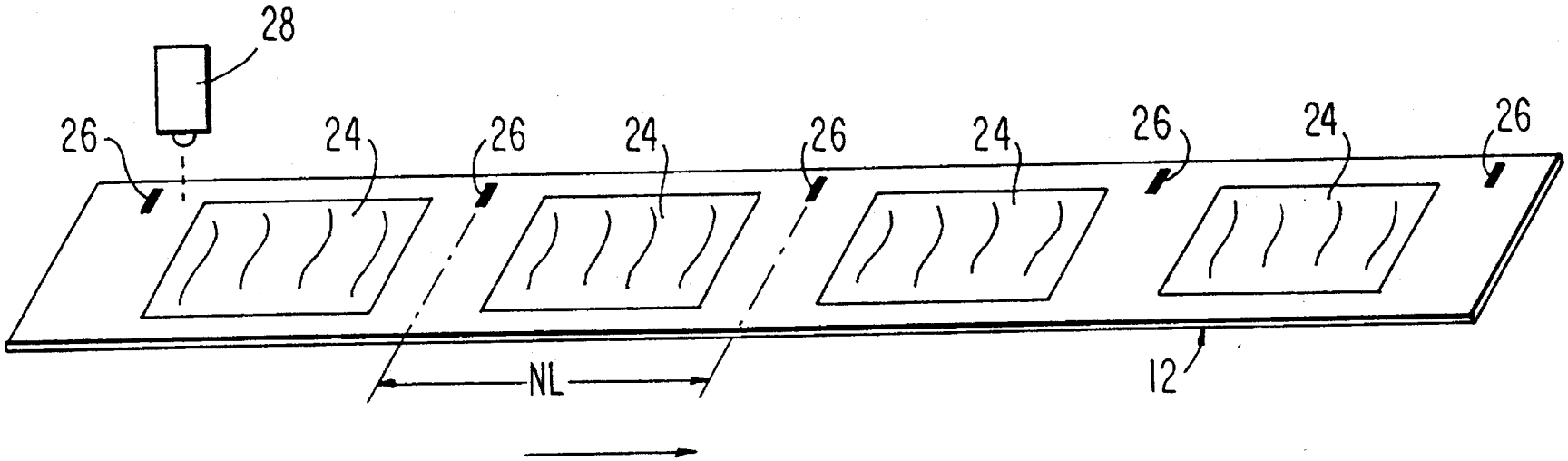
FIG. 2 is a diagrammatic view of a web and optical scanner showing the designations for various dimensions and parameters used in the description of a registration system in accordance with the invention.

Referring now to the drawings wherein like reference characters designate identical or corresponding parts throughout the several views, and more particularly to FIGS. 1 and 2, a bag machine 10 for making plastic bags from a continuous tubular web 12 of plastic material and equipped with a web registration system 14 according to the invention is illustrated. The web 12 is drawn from a supply roll (not shown) and is advanced forward through a pair of infeed rollers 16, a plurality of idler rollers 18 which maintain a supply of the web 12 under substantially constant tension, and then between a pair of draw rolls 20 positioned immediately upstream of a transverse cutting and sealing bar 22 which is mounted for reciprocation to cut and seal the web 12 after each web index movement to form the individual bags.

Referring to FIG. 2, the web 12 includes a plurality of graphic fields 24 printed repetitively along its length and is transversely cut and sealed by means of the cutting and sealing bar 22 at non-printed areas situated between the fields 24. In order to facilitate proper positional registration between the web 12 and the cutting and sealing bar 22 so that each bag is cut and sealed at an area between adjacent graphic fields 24, a plurality of regularly spaced eyemarks 26 are printed along a margin of web 12, the distance between adjacent eyemarks 26 constituting the nominal length NL of the finished bags. An optical scanner 28 is provided which photoelectrically senses the passage of each eyemark 26 and sends a detection signal to a controller as described below.

In accordance with the invention, in addition to the optical scanner 28, the web registration system 14 includes a controller 30, a control panel 32 by which an operator can input information to the controller 30, an encoder 34, and a servomotor 48. The bag machine 10 further includes a main drive motor 36 which drives a main drive shaft 38 by means of a belt 40. The reciprocation of the cutting and sealing bar 22 is accomplished by means of a conventional mechanism (not shown) driven by the main drive shaft 38 through gears 42 and 44, and belt 46. The encoder 34 is coupled to and receives a position-indicating output from the main drive shaft 38 which drives the cutting and sealing bar 22 and is operable to provide a signal to controller 30 indicative of the rotational position of main shaft 38 and, in turn, the position of the cutting and sealing bar 22. The controller 30 is coupled to and controls the operation of a servomotor 48 which drives the draw rolls 20 by means of a belt 50. The servomotor preferably operates the draw rolls within 180° of the 360° cycle of the main drive shaft which operates the cutting and sealing bar 22.

Generally, in accordance with the invention, the operator inputs a value for the nominal length NL of the bags, i.e. the distance between the eyemarks 26, and the length W of the registration window i.e. the maximum distance that is expected for the web to travel from the start of its advance motion to the time that an eyemark is initially detected, into controller 30 through control panel 32 whereby a predetermined draw length D for subsequent web indexes is calculated by suitable circuitry. The first web index is initiated with the draw rolls beginning to rotate at a time determined by the encoder 34 which monitors the position of the main drive shaft 38 which drives the cutting and sealing bar 22. The controller 30 enables, i.e. activates, the scanner 28 which then detects the passage of an eyemark 26 on web 12 at the beginning of the web index. The predetermined draw length D of the ongoing web advance is then adjusted based on the initial length E that the web has moved from the start of that web advance until the initial eyemark is sensed by the optical scanner. In this fashion, the web registration system of the invention operates by monitoring the position of the eyemark at the beginning of each web index, rather than at the end of the index as is conventional.

More particularly, in accordance with a preferred embodiment of the invention, an operator initially positions the web 12 on the bag machine so that an eyemark 26 is just about to come into view of the optical scanner 28. On receipt of a run signal, the controller 30 calculates the predetermined draw length D for the web indexes. According to the preferred embodiment of the invention, the predetermined draw length is equal to the nominal bag length NL less 30% of the registration window, which may generally range from 0.100 to 0.999 inches. On detection of the eyemark, the controller calculates the initial length E travelled by the web from the beginning of its advance until the eyemark has been detected. This initial distance E is then added to the predetermined draw length of the web advance that is currently in progress.

Figure 3A:
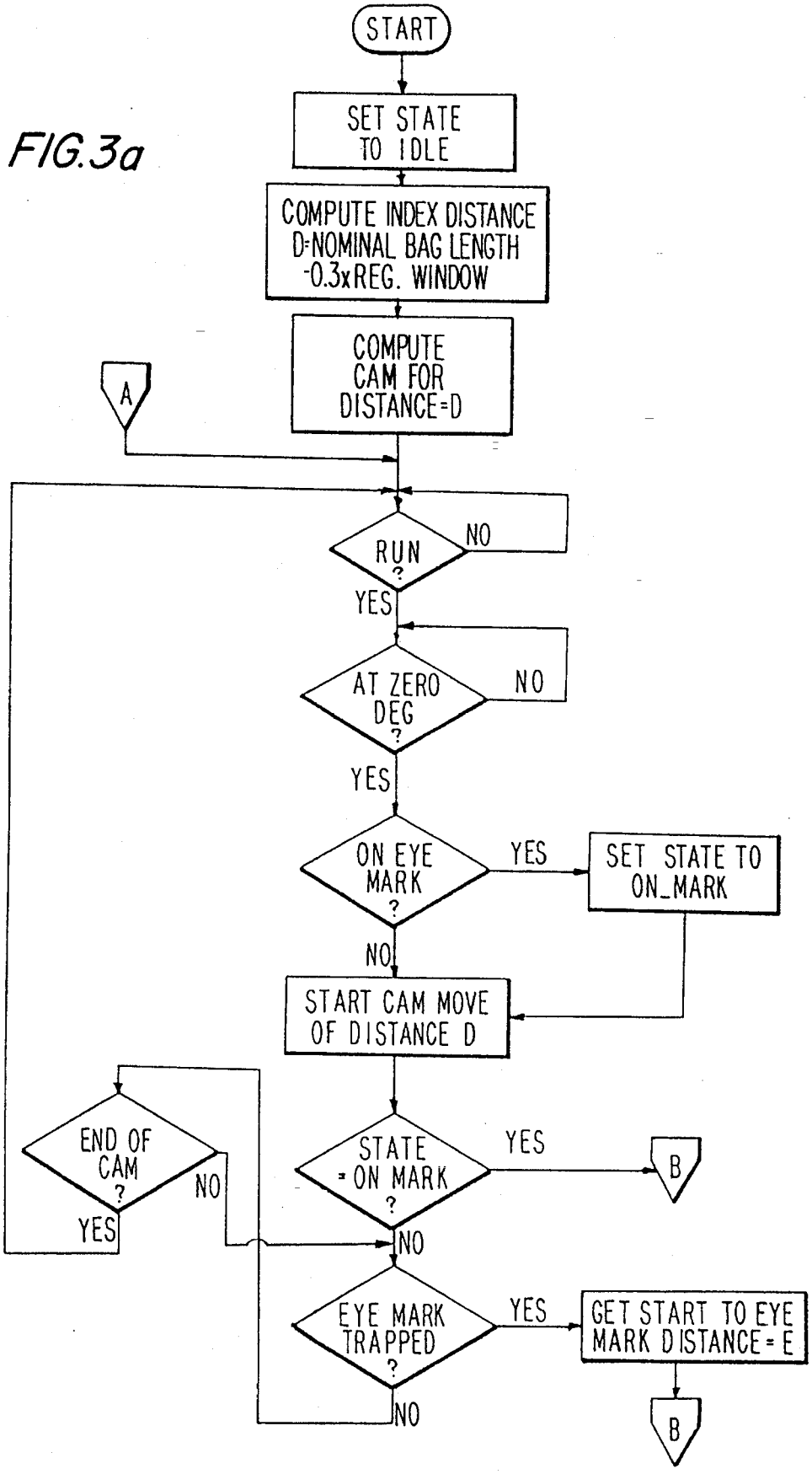
FIGS. 3*a* and 3*b* are flow charts showing the operation of a web registration system in accordance with the invention.
Figure 3B:
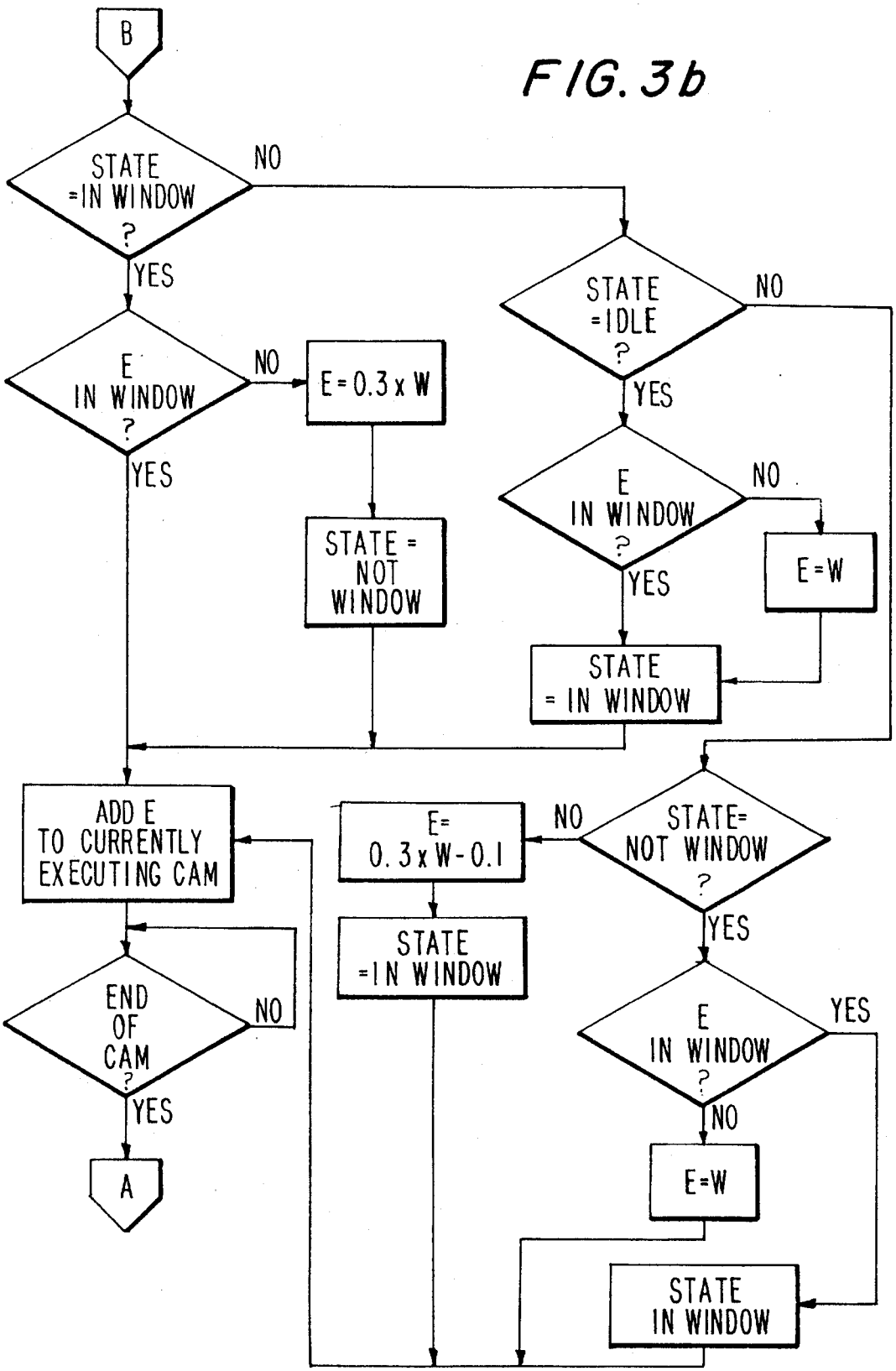

The continued operation of the bag making machine depends upon the particular "state" of the machine at the beginning of each new web index. Referring to FIG. 3 which illustrates a flow diagram showing the operation of a preferred embodiment of the registration system, as noted above, the machine operator initially inputs into the controller the nominal bag length NL which is normally the distance between successive eyemarks printed on the plastic web, and the registration window, normally between 0.1" and 0.999" representing the distance that the web is expected to move from its start position until an eyemark is detected by the optical sensor.

As discussed above after completion of the operator data entry, the controller 30 calculates the predetermined draw length D for of the upcoming web indexes in accordance with the following:

$$D=NL-0.3W$$

where D is the predetermined draw length, NL is the nominal bag length, and W is the length of the registration window. At the beginning of the operation of the machine, the machine state is set to IDLE.

Upon receipt of a run signal, the servomotor 48 is locked through the encoder 34 to the cutting and sealing bar 22 so that the motion of the draw rolls 20 will begin at a 0° position of the encoder 34. As the web begins to move, the controller 30 monitors the receipt of a signal from the optical scanner 28 indicative of detection of an eyemark 26. If the eyemark 26 is already present and detected at the instant that the web index begins, the machine state is set to ON MARK. If no eyemark is detected after the web has been indexed over the entire predetermined draw length D, then no adjustment is made to the predetermined draw length D for that web index, and no change is made in the machine state.

If an eyemark is detected after the movement of the web has begun, the initial length E that the web has moved until the mark has been detected is recorded. The predetermined draw length is then adjusted based upon the initial length E, and upon the state of the machine, as follows:

1. State=IDLE. If the initial length E is within the registration window W, the actual draw distance for that web index is adjusted to D+E, and the machine state is set to IN WINDOW. If the initial length E is not within the registration window, the value of the length of the registration window itself is added to the predetermined draw length of the ongoing web index, resulting in an actual draw distance of D+W. The machine state is then set to IN WINDOW.

2. State=IN WINDOW. If the initial distance E is within the registration window, the actual draw distance for the ongoing web advance is D+E. If the initial length E is not within the registration window, then an adjustment of 0.3 W is made to the predetermined draw length D so that the actual draw distance for that ongoing web advance is NL. The machine state is set to NOT WINDOW.

3. State=NOT WINDOW. If the initial length E is within the registration window, then the initial length is added to the predetermined draw length so that the actual distance for the ongoing web advance is D+E. The machine state is then set to IN WINDOW. If the initial distance E is not within the registration window, an adjustment of W is made to the predetermined draw length resulting in a feed length for that ongoing web advance of D+W.

4. State=ON MARK. In certain cases, an eyemark may be situated directly under the optical sensor at the very instant that the web index begins. In this case, a value of 0.3 W–0.1" is added to the predetermined draw length resulting in an actual draw distance for that ongoing web advance of NL–0.1". The machine state is then set to IN WINDOW.

On completion of each web index, the servomotor is again locked to the encoder so that at the next occurrence of its 0° position, based upon the position of the sealing and cutting bar, a web advance having a predetermined draw length of D will begin. The process repeats continuously until the machine is stopped.

It will be understood that in accordance with the invention, it is the distance between the start of web motion and the detection of an eyemark during a web index, i.e. the initial length E, which determines the distance of the web advance in that same web index.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a plastic bag making machine for making plastic bags from an elongate web of plastic material having a series of regularly spaced eyemarks printed thereon, the improvement comprising:

draw roll means for intermittently advancing the web over respective draw lengths;

optical scanner means for detecting the passage of an eyemark by a certain location at an initial part of an ongoing web index;

means for calculating a predetermined draw length D prior to upcoming web indexes, said means for calculating said predetermined draw length D calculating the same in accordance with the formula, $$D=NL-K\cdot W,$$

where D is the predetermined draw length, NL is the nominal bag length equal to the distance between adjacent eyemarks, W is the length of a registration window in which an eyemark will normally be detected by said optical sensor means at said initial part of said ongoing web index, and K is a constant;

means for calculating during said ongoing web index an initial length E, if any, travelled by the web from the beginning of said ongoing web index to the detection of the passage of an eyemark; and means for adjusting said predetermined draw length D of said ongoing web index based upon said initial length E.

2. The improvement of claim 1 wherein said bag machine further includes transverse sealing and cutting means mounted over said web for reciprocating movement, and wherein said draw roll means include a pair of draw rolls and a servomotor for driving said pair of draw rolls, and wherein said servomotor is coupled to said sealing and cutting means through encoder means whereby the initiation of the motion of said draw rolls a function of the position of said cutting and sealing means.

3. The improvement of claim 1 wherein K is about 0.3.

4. The improvement of claim 1 wherein W is in the range of between about 0.1 to 0.999 inches.

5. The improvement of claim 1 wherein said means for adjusting said predetermined draw length comprises means for adding said initial length E to said predetermined draw length D in the case that said initial length E is less than or equal to said length W of said registration window.

6. The improvement of claim 1 wherein said means for adjusting said predetermined draw length comprises means for adding said length of said registration window W to said predetermined draw length D in the case that said initial length E is greater than said length W of said registration window.

7. The improvement of claim 1 wherein said means for adjusting said predetermined draw length comprises means for adding a quantity $$KW-L$$

to said predetermined draw length in the case that said initial length E is substantially equal to zero, wherein L is a constant in the range of between 0 and 0.2".

8. The improvement of claim 7 wherein L is about 0.1".

9. The improvement of claim 1 wherein said means for adjusting said predetermined draw length comprises, means for adding said initial length E to said predetermined draw length D in the case that said initial length E is less than or equal to said length W of said registration window, means for adding said length of said registration window W to said predetermined draw length D in the case that said initial length E is greater than said length W of said registration window; and means for adding KW–L to said predetermined draw length in the case that said initial length E is substantially equal to zero, wherein L is a constant in the range of between about 0 and 0.2".

10. The improvement of claim 1 wherein said means for adjusting said predetermined draw length calculated for said ongoing web index further includes means for determining during an ongoing web index whether said initial length E of said ongoing web index is less than or equal to said registration window length, or greater than said registration window length, or substantially equal to zero.

11. A method for facilitating the registration of a cutting and sealing bar with non-printed areas of a plastic web situated between repetitively printed graphic fields comprising the steps of:

calculating a predetermined draw length D prior to upcoming web indexes in accordance with the formula D=NL–KW, where D is the predetermined draw length, NL is the nominal bag length equal to the distance between adjacent eyemarks, W is the length of a registration window in which an eyemark will normally be detected, and K is a constant;

detecting the passage of an eyemark by a certain location at an initial part of an ongoing web index;

calculating during that web index an initial length E, if any, travelled by the web from the beginning of an ongoing web index to the detection of the passage of an eyemark; and adjusting the predetermined draw length D of the ongoing web index based upon the initial length E.

12. The method of claim 11 in which said step of adjusting the predetermined draw length comprises adding the initial length E to the predetermined draw length D when the initial length E is less than or equal to the length W of the registration window.

13. The method of claim 11 wherein the step of adjusting the predetermined draw length comprises adding the length of the registration window W to the predetermined draw length D when the initial length E is greater than the length W of the registration window.

14. The method of claim 11 wherein said step of adjusting said predetermined draw length comprises adding a quantity KW–L to the predetermined draw length where the initial length E is substantially equal to zero, and wherein L is a constant in the range of between 0 and 0.2".

15. The method of claim 11 wherein said step of adjusting said predetermined draw length comprises the steps of, adding the initial length E to the predetermined draw length D when the initial length E is less than or equal to the length W of the registration window, adding the length of said registration window W to the predetermined draw length D where the initial length E is greater than the length W of the registration window; and adding KW–L to the predetermined draw length when the initial length E is substantially equal to zero, wherein K is constant and L is a constant in the range of between about 0 and 0.2".

16. In a plastic bag making machine for making plastic bags from an elongate web of plastic material having a series of regularly spaced eyemarks printed thereon, the improvement comprising:

draw roll means for intermittently advancing the web over respective draw lengths;

means for calculating a predetermined draw length D prior to upcoming web indexes;

optical scanner means for detecting the passage of an eyemark by a certain location at an initial part of an ongoing web index;

means for calculating during said ongoing web index an initial length E, if any, travelled by the web from the beginning of said ongoing web index to the detection of the passage of an eyemark; and means for determining the draw length of said ongoing web index in which said initial length E is calculated prior to the passage of a subsequent eyemark by adjusting said predetermined draw length D based upon said initial length E.

17. The improvement of claim 16, wherein said bag machine further includes transverse sealing and cutting means mounted over said web for reciprocating movement, and wherein said draw roll means include a pair of draw rolls and a servomotor for driving said pair of draw rolls, and wherein said servomotor is coupled to said sealing and cutting means through encoder means whereby the initiation of the motion of said draw rolls a function of the position of said cutting and sealing means.

18. The improvement of claim 17, wherein said means for calculating said predetermined draw length D calculates the same in accordance with the formula, $$D=NL-K\cdot W,$$

where D is the predetermined draw length, NL is the nominal bag length equal to the distance between adjacent eyemarks, W is the length of a registration window in which an eyemark will normally be detected by said optical sensor means at said initial part of said ongoing web index, and K is a constant.

19. The improvement of claim 18, wherein K is about 0.3.

20. The improvement of claim 18, wherein W is in the range of between about 0.1 to 0.999 inches.

21. The improvement of claim 18, wherein said means for determining the draw length of said ongoing web index comprises means for adding said initial length E to said predetermined draw length D in the case that said initial length E is less than or equal to said length W of said registration window.

22. The improvement of claim 18, wherein said means for determining the draw length of said ongoing web index comprises means for adding said length of said registration window W to said predetermined draw length D in the case that said initial length E is greater than said length W of said registration window.

23. The improvement of claim 18, wherein said means for determining the draw length of said ongoing web index comprises means for adding a quantity $$K\cdot W-L$$

to said predetermined draw length in the case that said initial length E is substantially equal to zero, wherein L is a constant in the range of between 0 and 0.2".

24. The improvement of claim 23, wherein L is about 0.1".

25. The improvement of claim 18, wherein said means for determining the draw length of said ongoing web index comprises, means for adding said initial length E to said predetermined draw length D in the case that said initial length E is less than or equal to said length W of said registration window, means for adding said length of said registration window W to said predetermined draw length D in the case that said initial length E is greater than said length W of said registration window; and means for adding K·W–L to said predetermined draw length in the case that said initial length E is substantially equal to zero, wherein L is a constant in the range of between about 0 and 0.2".

26. The improvement of claim 16, wherein said means for determining the draw length of said ongoing web index further includes means for determining during an ongoing web index whether said initial length E of said ongoing web index is less than or equal to said registration window length, or greater than said registration window length, or substantially equal to zero.

27. A method for facilitating the registration of a cutting and sealing bar with non-printed areas of a plastic web situated between repetitively printed graphic fields, comprising the steps of:

calculating a predetermined draw length D prior to upcoming web indexes;

detecting the passage of an eyemark by a certain location at an initial part of an ongoing web index;

calculating during that web index an initial length E, if any, travelled by the web from the beginning of an ongoing web index to the detection of the passage of an eyemark; and determining the draw length of said ongoing web index in which the initial length E was calculated prior to the passage of a subsequent eyemark by adjusting the predetermined draw length D based upon the initial length E.

28. The method of claim 27, wherein the calculation of the predetermined draw length D is in accordance with the formula D= NL–K·W, where D is the predetermined draw length, NL is the nominal bag length equal to the distance between adjacent eyemarks, W is the length of a registration window in which an eyemark will normally be detected, and K is a constant.

29. The method of claim 28, wherein the registration window has a length W and said step of determining the draw length of said ongoing web index comprises adding the length of the registration window W to the predetermined draw length D when the initial length E is greater than the length W of the registration window.

30. The method of claim 27, wherein the registration window has a length W and said step of determining the draw length of said ongoing web index comprises adding the initial length E to the predetermined draw length D when the initial length E is less than or equal to the length W of the registration window.

31. The method of claim 27, wherein the registration window has a length W and said step of determining the draw length of said ongoing web index comprises adding a quantity K·W–L to the predetermined draw length where the initial length E is substantially equal to zero, and wherein L is a constant in the range of between 0 and 0.2".

32. The method of claim 27, wherein the registration window has a length W and said step of determining the draw length of said ongoing web index comprises the steps of:

adding the initial length E to the predetermined draw length D when the initial length E is less than or equal to the length W of the registration window, adding the length of said registration window W to the predetermined draw length D where the initial length E is greater than the length W of the registration window; and adding K·W–L to the predetermined draw length when the initial length E is substantially equal to zero, wherein K is constant and L is a constant in the range of between about 0 and 0.2".

* * * * *